US010191417B2

(12) United States Patent
Nojima et al.

(10) Patent No.: US 10,191,417 B2
(45) Date of Patent: Jan. 29, 2019

(54) FIXING DEVICE HAVING A COVER MEMBER THAT COVERS A FIXATION ROLLER

(71) Applicant: CANON KABUSHIKI KAISHA, Tokyo (JP)

(72) Inventors: Koji Nojima, Abiko (JP); Kota Aoki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/316,863

(22) PCT Filed: Sep. 10, 2015

(86) PCT No.: PCT/JP2015/076373
§ 371 (c)(1),
(2) Date: Dec. 7, 2016

(87) PCT Pub. No.: WO2016/039487
PCT Pub. Date: Mar. 17, 2016

(65) Prior Publication Data

US 2017/0108805 A1 Apr. 20, 2017

(30) Foreign Application Priority Data

Sep. 10, 2014 (JP) ..... 2014-183953

(51) Int. Cl.
*G03G 15/20* (2006.01)

(52) U.S. Cl.
CPC ..... *G03G 15/2025* (2013.01)

(58) Field of Classification Search
CPC ..... G03G 15/2025; G03G 15/2075
See application file for complete search history.

(56) References Cited

U.S. PATENT DOCUMENTS 4,618,240 A * 10/1986 Sakurai ..... G03G 15/2053 219/216
5,713,069 A 1/1998 Kato
(Continued)

FOREIGN PATENT DOCUMENTS

JP 6028680 A 2/1985
JP 6041071 A 3/1985
(Continued)

OTHER PUBLICATIONS

International Search Report & Written Opinion of Parent International Application No. PCT/JP2015/076373 dated Dec. 10, 2015.
Office Action dated Mar. 27, 2018, issued in Japanese Patent Application No. 2014-183953.

*Primary Examiner* — David M. Gray
*Assistant Examiner* — Andrew V Do
(74) *Attorney, Agent, or Firm* — Venable LLP

(57) ABSTRACT

A fixing apparatus includes a first rotatable member configured to heat, in a fixing nip, an unfixed toner image formed on a sheet with a toner having a parting material. A second rotatable member cooperates with the first rotatable member to form the fixing nip. A cleaner is configured to clean the first rotatable member, and a covering member is configured to cover the first rotatable member over a range from the cleaner to an entrance of the fixing nip along a rotational direction of the first rotatable member with a gap D of not less than 0.5 mm and not more than 3.5 mm. In addition, the gap D (mm) between the covering member and the first rotatable member and the peripheral speed V of the first rotatable member (mm/s) satisfy $0.5 \leq D \leq 0.0059 \times V + 0.72$.

6 Claims, 8 Drawing Sheets

(56) References Cited

U.S. PATENT DOCUMENTS

| | | | | |
|---|---|---|---|---|
| 5,903,809 | A | 5/1999 | Tomatsu | |
| 9,152,097 | B2 | 10/2015 | Nojima et al. | |
| 9,188,951 | B2 | 11/2015 | Nojima | |
| 9,250,578 | B2 | 2/2016 | Aoki | |
| 9,383,696 | B2 | 7/2016 | Nojima et al. | |
| 9,411,275 | B2 | 8/2016 | Sugiyama et al. | |
| 9,465,360 | B2 | 10/2016 | Aoki et al. | |
| 9,501,008 | B2 | 11/2016 | Nojima et al. | |
| 2005/0175919 | A1* | 8/2005 | Hayashi | G03G 9/0821 430/108.4 |
| 2006/0086723 | A1 | 4/2006 | Nagahira | |
| 2011/0091230 | A1 | 4/2011 | Yamamoto | |
| 2011/0243598 | A1 | 10/2011 | Suzuki | |
| 2013/0302073 | A1 | 11/2013 | Takeuchi | |
| 2014/0086616 | A1 | 5/2014 | Nojima et al. | |

FOREIGN PATENT DOCUMENTS

| | | | |
|---|---|---|---|
| JP | H03-101780 | A | 4/1991 |
| JP | H09-152798 | A | 6/1997 |
| JP | 2000-089596 | A | 3/2000 |
| JP | 2005-056595 | A | 3/2005 |
| JP | 2005-202118 | A | 7/2005 |
| JP | 2006-119463 | A | 5/2006 |
| JP | 2006-163427 | A | 6/2006 |
| JP | 2010217580 | A | 9/2010 |
| JP | 2010-249874 | A | 11/2010 |
| JP | 2011-081223 | A | 4/2011 |
| JP | 2011-085845 | A | 4/2011 |
| JP | 2011112708 | A | 6/2011 |
| JP | 2013-235157 | A | 11/2013 |
| JP | 2014-077989 | A | 5/2014 |

* cited by examiner

FIXING DEVICE HAVING A COVER MEMBER THAT COVERS A FIXATION ROLLER

This application claims the benefit of International Patent Application No. PCT/JP2015/076373, under 35 U.S.C. § 317, which claims the benefit of Japanese Patent Application No. 2014-183953, filed Sep. 10, 2014, both of which are hereby incorporated by reference herein in their entireties.

FIELD OF THE INVENTION

The present invention relates to a fixing device that fixes a toner image on a sheet of recording medium. A fixing device can be installed in an image forming apparatus, such as a copying machine, a printer, and a facsimile machine, and also, in multifunction image forming apparatuses that are capable of performing two or more functions of the image forming apparatuses mentioned above.

BACKGROUND ART

In the field of an electrophotographic image forming apparatus, it has been a common practice to use such toner that contains a releasing agent (wax), to form a toner image on a sheet of recording medium, and to use a fixing device to fix the formed toner image to the sheet by applying heat and pressure to the sheet and to the toner image thereon.

It is known that, during the fixation of a toner image, the wax in toner vaporizes, and then, immediately condenses. It has been known by the inventors of the present invention that, after the wax vaporizes and condenses, a large amount of microscopic particles of wax (that are several nanometers (nm) to several hundreds of nm in diameter, and hereafter may be referred to as dust) remain floating in the adjacencies of the fixing member of the fixing device. Unless these microscopic particles of wax, which result from the condensation of vaporized wax from the toner, are dealt with immediately after the condensation, it is possible that most of the particles will disperse out of the fixing device, which will have undesirable effects upon the images that are being formed by the image forming apparatus. Thus, in order to prevent the microscopic wax particles from dispersing out of the fixing device, it has been desired to turn the microscopic wax particles into particles of a larger size as soon as they are formed through the condensation of the vaporized wax.

In the case of the fixing device disclosed in Japanese Laid-open Patent Application No. 2010-217580, which employs an electromagnetic induction heating system, a heating member is disposed in the adjacencies of the coil holder of the device, in order to prevent the wax from cumulatively solidifying on the coil holder. More concretely, the fixing device is configured so that, as the cumulatively solidified wax on the coil holder is heated by the heating member, the wax liquefies and drips down.

In the case of the fixing device disclosed in Japanese Laid-open Patent Application No. 2011-112708, the cleaning web for removing the microscopic particles, which are remaining adhering to the fixation roller, is made of such material that contains an agent that is capable of capturing the microscopic particles.

In the case of the fixing devices disclosed in Japanese Laid-open Patent Application No. 2010-217580 and No. 2011-112708, however, it is impossible to prevent the large amount of dust, which is present in the adjacencies of the fixing member, from dispersing out of the fixing device. In other words, these patents cannot be solutions to the above-described problem.

SUMMARY OF THE INVENTION

In view of the problems described above, an object of the present invention is to provide a fixing device that can prevent the dust from dispersing straight out of the fixing device.

Another object of the present invention is to provide a fixing device that is greater in efficiency in terms of the process of turning the dust into particles of larger sizes than any conventional fixing device.

According to one aspect, the present invention provides a fixing apparatus comprising a first rotatable member configured to heat, in a fixing nip, an unfixed toner image formed on a sheet with toner comprising a parting material, a second rotatable member cooperative with the first rotatable member to form the fixing nip, a cleaner configured to clean the first rotatable member, and a covering member configured to cover the first rotatable member over a range from the cleaner to a neighborhood of an entrance of the fixing nip along a rotational direction of the first rotatable member with a gap of not less than 0.5 mm and not more than 3.5 mm.

Further features of the present invention will become apparent from the following description of exemplary embodiments with reference to the attached drawings.

BRIEF DESCRIPTION OF THE DRAWINGS

Part (a) of FIG. 1 is a schematic cross-sectional view of the essential section of the fixing device in one of the preferred embodiments of the present invention, and part (b) of FIG. 1 is a perspective view of the essential section of the same fixing device.

Figure 3:
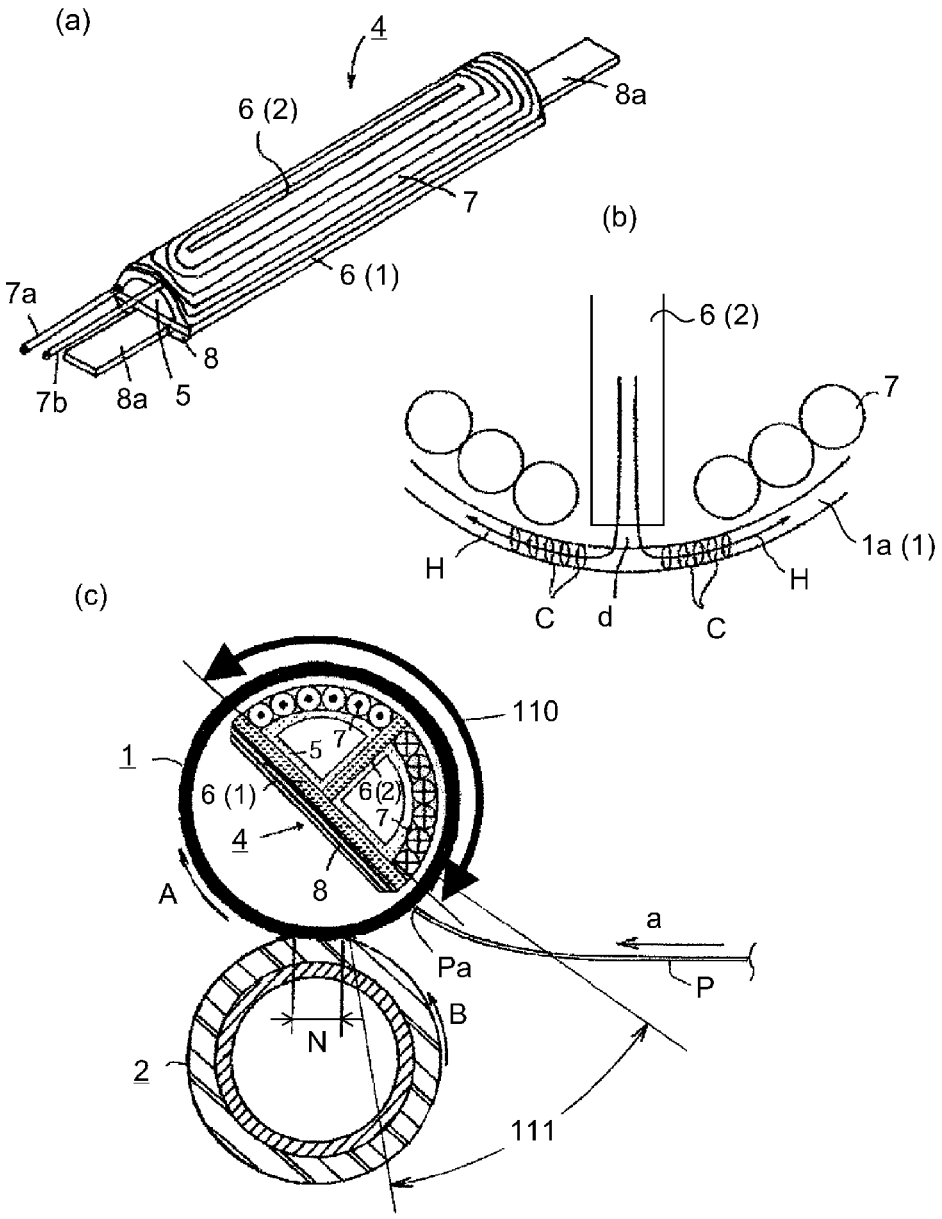

Parts (a), (b), and (c) of FIG. 3 illustrate a coil assembly.

Figure 4:
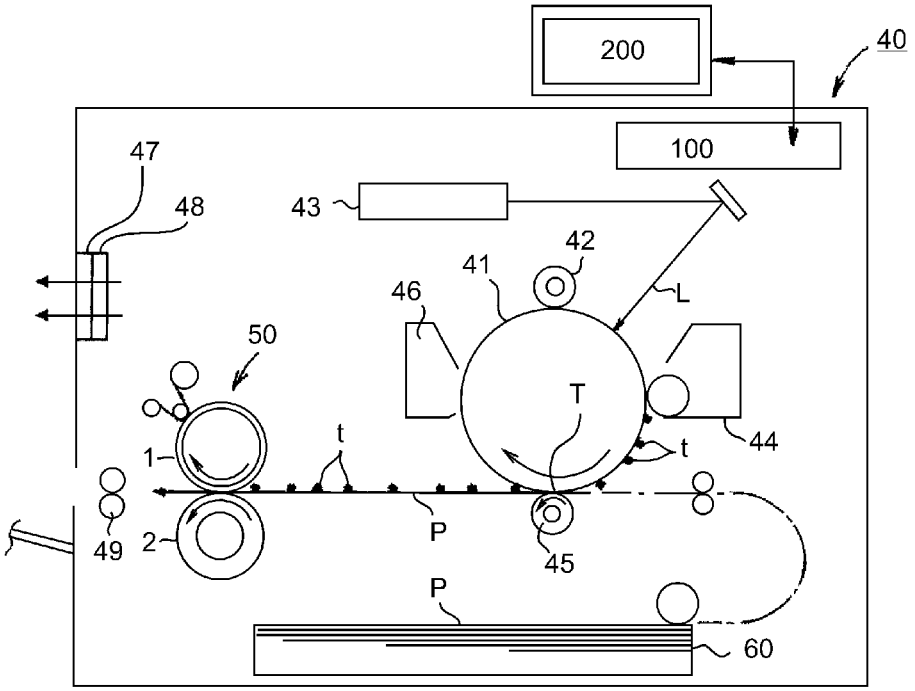

FIG. 4 is a schematic sectional view of the image forming apparatus in the embodiment, and shows the general structure of the image forming apparatus.

Figure 5:
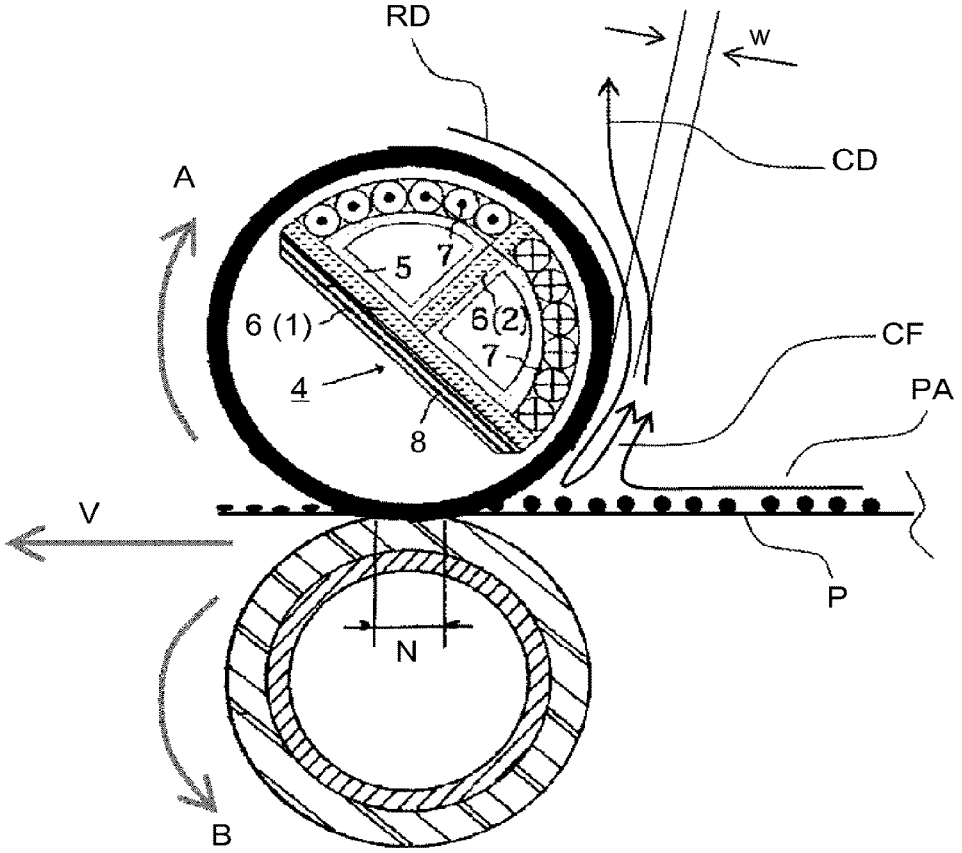

FIG. 5 is a drawing for describing the airflow in the adjacencies of the fixation roller, and the airflow in the adjacencies of the pressure roller.

Figure 6:
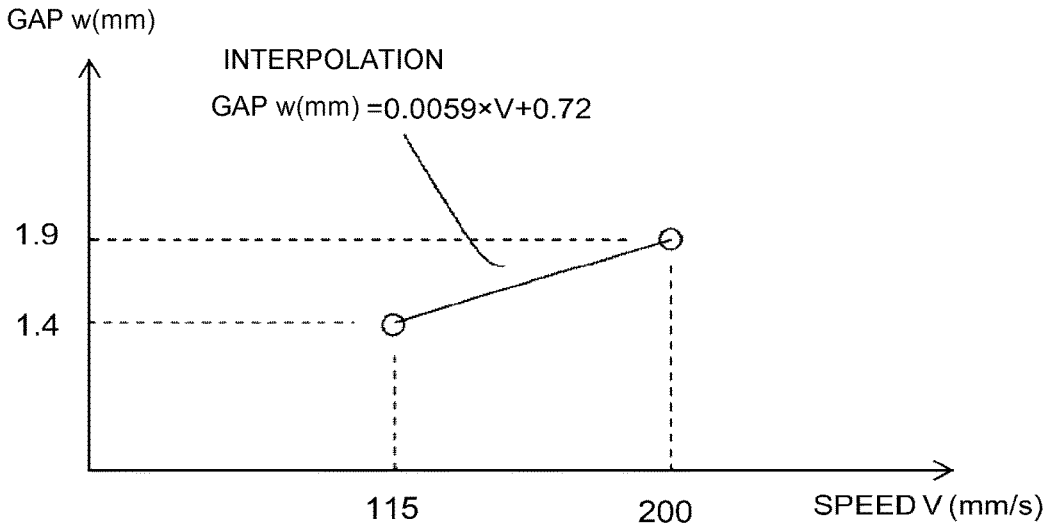

FIG. 6 is a graph that shows the relationship between the gap and a peripheral velocity.

Figure 7:
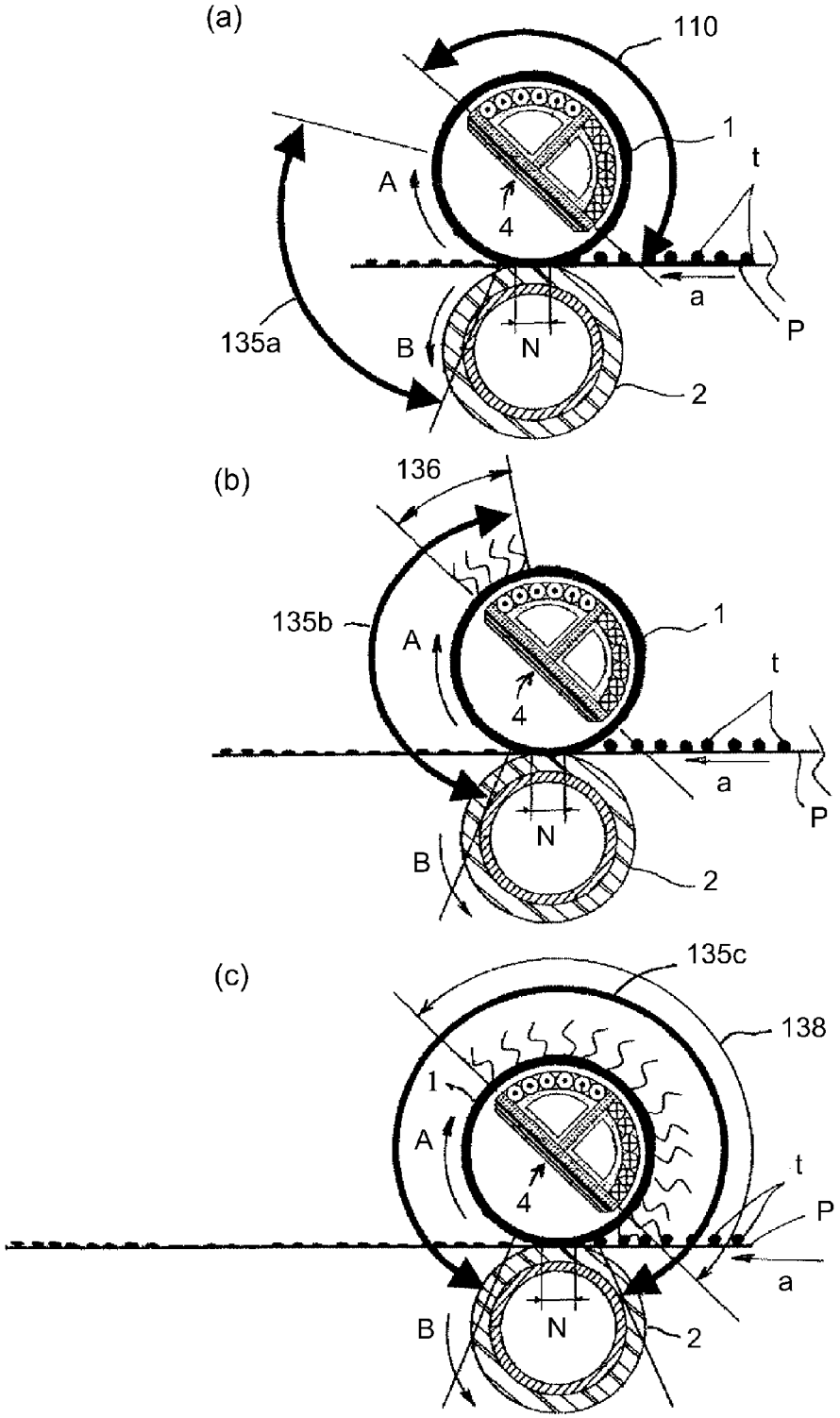

Parts (a), (b), and (c) of FIG. 7 illustrate the range in which the wax adheres to the fixation roller, and the range in which dust forms.

Figure 8:
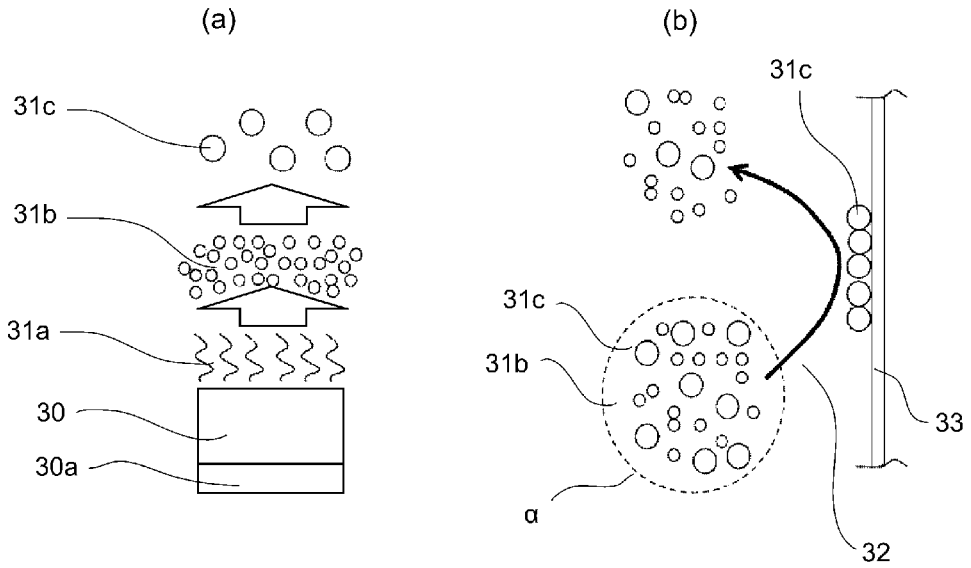

Part (a) of FIG. 8 is a schematic drawing for describing how the dust particles agglomerate into particles of a larger size, and part (b) of FIG. 8 is a schematic drawing for describing how and where the dust adheres in the fixing device.

DESCRIPTION OF THE EMBODIMENTS

Hereafter, one of the preferred examples of a fixing device in accordance with the present invention is described in detail. By the way, the various devices, components thereof, etc., in the following embodiment of the present invention can be replaced with any known structure, and is within the scope of the present invention, unless specifically noted.

Embodiment (1) Example of Image Forming Apparatus

FIG. 4 is a schematic sectional view of an image forming apparatus 40 equipped with a fixing device 50, in accordance with the present invention, that uses one of the electromagnetic induction heating methods. FIG. 4 shows the general structure of the image forming apparatus 40. This image forming apparatus 40 is a digital image forming apparatus (a copying machine, a printer, a facsimile machine, or a multifunction machine capable of performing two or more functions of the preceding machines, etc.). The image forming apparatus 40 uses one of electrophotographic processes, and also one of the laser-based scanning (exposing) methods.

A referential code 41 stands for a photosensitive member (that is in the form of a drum, and will be referred to as a drum 41, hereafter) as an image bearing member. The drum 41 is rotationally driven in the clockwise direction, indicated by an arrow mark in FIG. 4, at a preset peripheral velocity. A referential code 42 stands for the primary charging device (charge roller). In this embodiment, the charge roller 42 uniformly and negatively charges the drum 41 to a present level Vd (pre-exposure level). A referential code 43 stands for a laser beam scanner, as a drum exposing means, that scans (exposes) the drum 41 with a beam L of laser light that the laser beam scanner 43 outputs while modulating the beam L with digital image formation signals inputted into a control circuit 100 from a host apparatus 200, such as an image reading device, a computer, or the like.

At a given point of the peripheral surface of the drum 41 that is exposed to the beam L of laser light, this point is reduced in the absolute value of its potential to potential level V1 (post-exposure level). Consequently, an electrostatic latent image, which reflects the image formation signals, is effected on the peripheral surface of the drum 41 by the contrast between the pre-exposure potential level and post-exposure potential level. This electrostatic latent image is developed by a developing device 44. More specifically, as negatively charged toner particles adhere to the exposed points (that are V1 in potential level) of the peripheral surface of the drum 41, the electrostatic latent image is developed into a visible image, that is, an image formed of toner (that hereafter will be referred to as toner image t).

Meanwhile, one of the sheets P of recording medium, such as a sheet of recording paper (that hereafter will be referred to as sheet of paper), is fed into the main assembly of the image forming apparatus 40 from the sheet feeding section 60, and is conveyed, with a preset control timing, to the transfer section T, in which a transfer roller 45, as a transferring member, to which transfer bias is being applied, is kept pressed upon the drum 41. In the transfer section T, the toner image t formed on the drum 41 is transferred onto the sheet P of paper as it is peeled away from the peripheral surface of the drum 41. After the transfer of the toner image t onto the sheet P, the sheet P is introduced into the fixing device 50, which will be described later. In the fixing device 50, the toner image t is fixed to the surface of the sheet P by heat and pressure. After being conveyed out of the fixing device 50, the sheet P is conveyed further through a pair of discharge rollers 49, and is discharged, as a finished print, from the image forming apparatus 40.

After the sheet P of paper is separated from the image forming apparatus 40, in the transfer section T, the peripheral surface of the drum 41 is cleaned by a cleaning device 46. In particular, the transfer residual toner, that is, the toner that is remaining on the peripheral surface of the drum 41 after the transfer, is removed by the cleaning device 46, so that the peripheral surface of the drum 41 can be repeatedly used for image formation. The heated air discharged into the internal space of the image forming apparatus 40 from the fixing device 50 is exhausted from the image forming apparatus 40 by a fan 48. While the heated air is discharged from the image forming apparatus 40, the odor in the heated air is removed by a filter 47.

The control circuit 100 has a microcomputer (a central processing unit (CPU), for example, as its main control circuit. The control circuit 100 exchanges various electrical information signals with the host apparatus 200. Further, the control circuit 100 controls the processing of the electrical information signals inputted from the various processing devices and sensors of the image forming section (image formation system), the command signals to be sent to the various processing devices, the preset initialization sequence, the preset image formation sequence, etc.

By the way, the image forming apparatus 40 in this embodiment is a black-and-white image forming apparatus. The present invention is also applicable, however, to a color image forming apparatus, the image forming section of which has four developing devices that are different in the color of the monochromatic image they form, more specifically, four developing devices that develop an electrostatic latent image into C (cyan), M (magenta), Y (yellow), and K (black) toner images, one for one.

(2) Fixing Device 50

Figure 1:
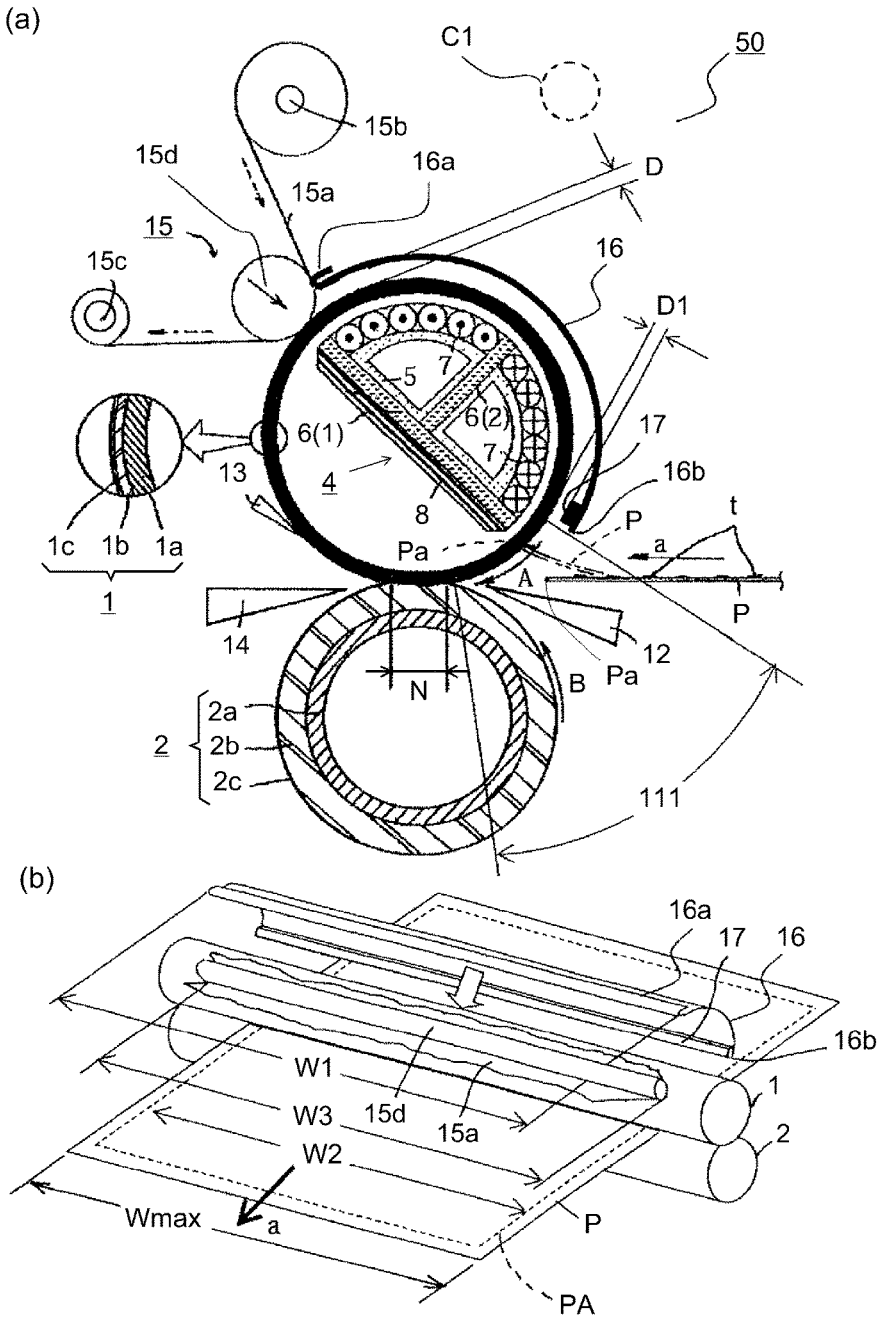
Figure 2:
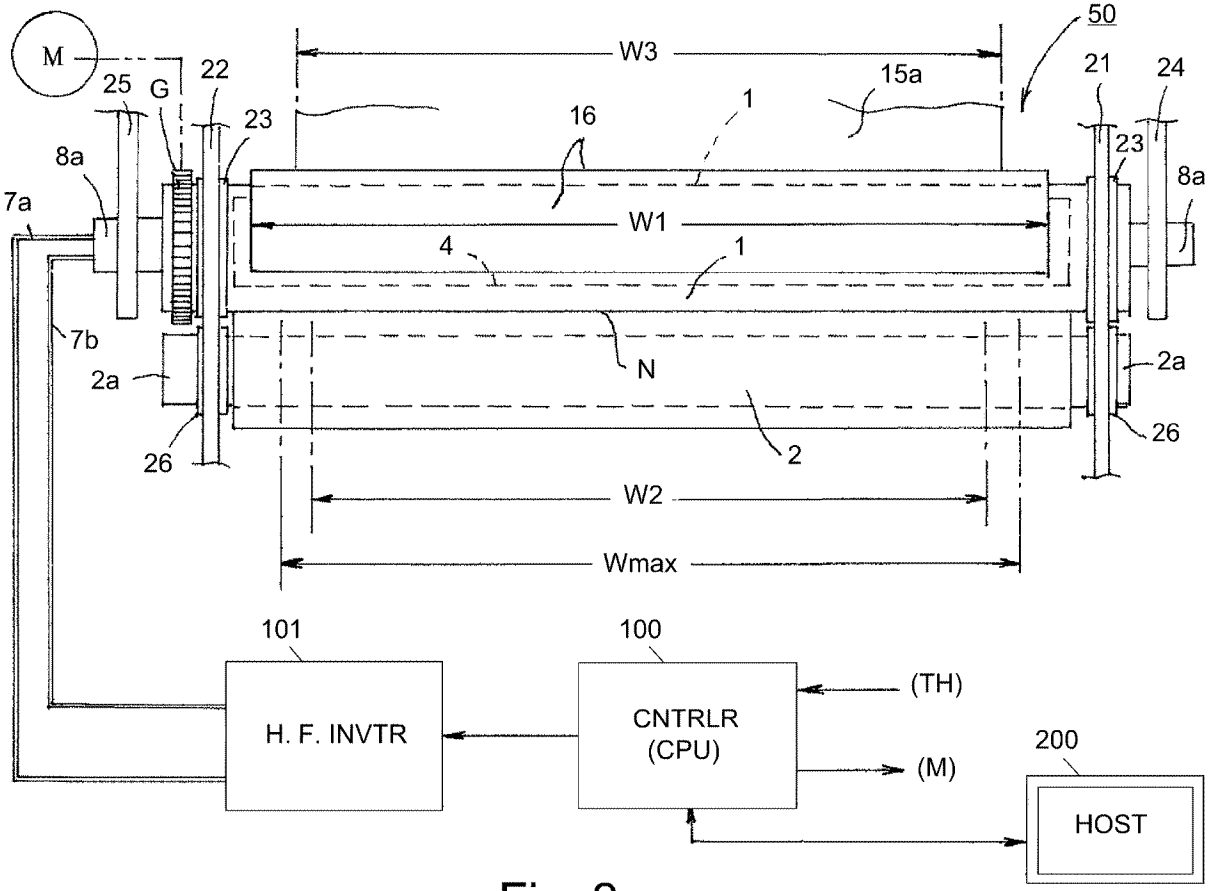
FIG. 2 is a front view of the essential section of the fixing device.

Part (a) of FIG. 1 is a schematic cross-sectional view of the essential section of the fixing device 50 in this embodiment, and part (b) of FIG. 1 is a schematic perspective view of the essential section of the fixing device 50. In comparison to part (a) of FIG. 1, part (b) of FIG. 1 is drawn in such a manner that the distance between the fixing device 50 and a cover 16 is substantially greater than the actual distance between the two components. FIG. 2 is a schematic front view of the essential section of the fixing device 50.

Regarding the positioning of the fixing device 50, the front side (operator side) is the side from which the sheet P of paper is introduced into the fixing device 50, and the back (rear) side is the opposite side from the front side. The left and right sides of the fixing device 50 are the left and right (rear and front, respectively) sides as seen from the front side. The upstream and downstream sides of the fixing device 50 are the upstream and downstream sides with reference to the sheet conveyance direction a or the rotational direction of a rotational member. The lengthwise and widthwise directions of the fixing device 50 are the directions that are parallel to the rotational axis of the rotational member. The lengthwise and widthwise measurements of the fixing device 50 or any component thereof are the measurements with reference to the above-described lengthwise and widthwise directions. The width of the sheet P of paper, or the widthwise size of the sheet P, is the measurement of the sheet P in terms of the direction that is perpendicular to the sheet conveyance direction a, at a plane that coincides with the surface of the sheet P.

The fixing device 50 in this embodiment is an image heating device that employs a fixation roller 1 (heat roller) that uses an electromagnetic induction heating system. The fixation roller 1 (cylindrical rotational member that can be heated by electromagnetic induction), as the first rotational member (image heating member), has an electrically conductive layer that can be heated by magnetic flux. The fixing device 50 has also a pressure roller 2, as a second rotational member (opposing member, nip forming member, pressure applying member), that is pressed against the fixation roller 1 to form a nip N (fixation nip) for thermally fixing the toner image t, while the sheet P of paper, on which the unfixed toner image t is present, is conveyed through the nip N.

Further, the fixing device 50 has a coil assembly 4 that is disposed in a hollow of the fixation roller 1. The coil assembly 4 has an excitation coil 7 that generates a high frequency magnetic field (alternating magnetic field) that causes a metallic core 1*a* (electrically conductive layer) of the fixation roller 1, which makes up an electrically conductive layer, to generate Joule's heat (heat that can be generated by electromagnetic induction) by inducing electric current (eddy current) in the electrically conductive layer 1*a*. Moreover, the fixing device 50 has a cleaner 15 for cleaning the peripheral surface of the fixation roller 1, and the cover 16 that covers the peripheral surface of the fixation roller 1, in a preset range in terms of the rotational direction of the fixation roller 1, with the presence of a preset gap D between the cover 16 and the fixation roller 1. Next, the abovementioned structural components of the fixing device 50 are described in detail.

(2-1) Fixation Roller 1

The fixation roller 1 in this embodiment is a hollow and laminar roller. It has the cylindrical metallic core 1*a* that makes up the electrically conductive layer (that may be formed as a magnetic shunt alloy layer, or a metallic layer), a heat resistant elastic layer 1*b* formed on the peripheral surface of the metallic core 1*a*, and a surface layer 1*c* formed on the outward surface of the elastic layer 1*b*.

The metallic core 1*a* is a cylindrical hollow roller that is 40 mm in external diameter, 1.2 mm in thickness, and 350 mm in length. In this embodiment, the metallic core 1*a* is formed of a magnetic shunt alloy that contains iron, nickel, chrome, manganese, etc., in such a ratio that a Curie temperature Tc of the alloy is 220° C., and a specific resistivity of the alloy is roughly 5 Ω·m.

In this embodiment, the Curie temperature Tc was set to a level that is no greater than the highest temperature (230° C. in this embodiment), that the fixing device 50 can withstand. That is, the temperature level at which the temperature of the fixation roller 1 is to be kept was set to a level that is less than the Curie temperature Tc of the fixation roller 1. Here, the highest temperature level that the fixing device 50 can withstand means the temperature level beyond which the damage to some of the components of the fixing device 50 will become substantial.

The elastic layer 1*b* is a heat resistant elastic layer formed of silicone rubber or the like. The elastic layer 1*b* is 250 μm in thickness. The elastic layer 1*b* is provided to enable the fixing device 50 to fix an unfixed toner image in such a manner that the image forming apparatus 40 is enabled to output high quality images, such as color images. The surface layer 1*c* is formed of fluorine resin such as perfluoroalkoxy (PFA), polytetrafluoroethylene (PTFE), or the like, and is 20 μm in thickness. The surface layer 1*c* is provided to enable the fixation roller 1 to efficiently release toner.

The fixation roller 1 is rotatably supported by a right (front side) lateral plate 21 and a left (rear side) lateral plate 22, which are parts of a frame (fixation unit frame) of the fixing device 50, with the placement of a pair of bearings 23, one for one, by which the left and right ends of the fixation roller 1 are borne, respectively.

To the left end of the fixation roller 1, a drive gear G for rotationally driving the fixation roller 1 is coaxially fixed. As a driving force is transmitted to the drive gear G from a driving force source M, which is under the control of the control circuit 100, through a driving force transmission system (drive trains), the fixation roller 1 is rotationally driven in the clockwise direction indicated by an arrow mark A in part (a) of FIG. 1, at a preset peripheral velocity.

(2-2) Coil Assembly 4

As noted, the coil assembly 4 having the excitation coil 7 is disposed in the hollow of the fixation roller 1. The coil assembly 4 having the excitation coil 7 generates high frequency magnetic field (alternating magnetic field) to generate Joule's heat by inducing eddy current in the metallic core 1*a*. Part (a) of FIG. 3 is an external perspective view of the coil assembly 4. The coil assembly 4 extends in the direction parallel to the rotational axis of the fixation roller 1. The coil assembly 4 has a bobbin 5, a magnetic core 6 formed of a magnetic substance, and the excitation coil 7. The magnetic core 6 is held by the bobbin 5. The excitation coil 7 is formed by winding a piece of electrical wire around the bobbin 5. More specifically, the bobbin 5 also extends in the direction parallel to the rotational axis of the fixation roller 1. Therefore, the lengthwise direction of the excitation coil 7 is parallel to the rotational axis of the fixation roller 1. The magnetic core 6 is disposed in the adjacencies of the excitation coil 7, and guides the magnetic flux to the metallic core 1*a*, which makes up the electrically conductive layer of the fixation roller 1. The bobbin 5, the magnetic core 6, and the excitation coil 7 are integrally fixed to a stay 8, being thereby supported by the stay 8.

The coil assembly 4 is stationarily supported by a left supporting member 24 and a right supporting member 25 of the fixing device 50, by lengthwise ends 8*a* of the stay 8, with the presence of a preset amount of gap d (part (b) of FIG. 3) between an inward surface of the fixation roller 1 and the excitation coil 7. The bobbin 5, the magnetic core 6, and the excitation coil 7 are disposed in the hollow of the fixation roller 1 in such a manner that they are not exposed from the fixation roller 1.

The magnetic core 6 is made of ferrite, Permalloy®, or a like substance, which are high in permeability and low in residual magnetic flux density. The magnetic core 6 is for guiding the magnetic flux, generated by the excitation coil 7, to the metallic core 1*a* of the fixation roller 1. The magnetic core 6 in this embodiment is shaped like the letter T in cross section. The magnetic core 6 is a combination of two pieces 6(1) and 6(*b*) of magnetic plates, and, more specifically, is a combination of a horizontal section that is equivalent to the horizontal portion of a letter T, and a vertical section that is equivalent to the vertical section of a letter T.

The excitation coil 7 is a coil that is formed by winding a piece of Litz wire several times around the magnetic core 6(1) in such a manner that the cross section of the resulting excitation coil 7 matches that of the bobbin 5, which is roughly in the shape of a long and narrow boat, and also, that the contour of the coil becomes such that there will be a preset gap between the excitation coil 7 and an inward surface of the fixation roller 1. That is, the excitation coil 7 is wound in such a manner that its lengthwise direction becomes parallel to the rotational axial line of the fixation roller 1. The excitation coil 7 heats the metallic core 1*a* of the fixation roller 1 by generating magnetic flux that is perpendicular to the rotational axis of the fixation roller 1. That is, the fixation roller 1 is heated by electromagnetic induction.

Referential codes 7*a* and 7*b* stand for a pair of lead wires (that supply the excitation coil 7 with electrical current) of the above-described excitation coil 7. The wires 7*a* and 7*b* are extended from the left side of the stay 8, from within the fixation roller 1, and are in contact with a high frequency inverter 101 (high frequency circuit) that supplies the excitation coil 7 with high frequency electrical current. The high frequency inverter 101 has a switching element that is turned on and off to flow preset high frequency electrical current through the excitation coil 7. The high frequency inverter 101 in this embodiment operates at a preset voltage (100 V), and its electrical power output is determined by the change in current value, and the length of time the electrical current is kept on and off.

(2-3) Pressure Roller 2

The pressure roller 2 is a heat resistant, multilayered, and elastic roller. It has a metallic core 2*a*, a heat resistant elastic layer 2*b* that is coaxially formed, like a roller, around the metallic core 2*a*, and a surface layer 2*c* formed on the outward surface of the elastic layer 2*b*.

In this embodiment, the metallic core 2*a* is a piece of metallic pipe that is 38 mm in external diameter, 3 mm in thickness, and 350 mm in length. The elastic layer 2*b* is in the form of a hollow roller, and covers virtually the entirety of the peripheral surface of the metallic core 2*a*, except for the left and right end portions of the metallic core 2*a*that have a preset length. The surface layer 2*c* is formed of PFA, PTFE, or the like fluorine resin, and is 100 μm in thickness.

The pressure roller 2 is disposed under the fixation roller 1 roughly in parallel to the fixation roller 1. The pressure roller 2 is rotatably held by its lengthwise ends, by the right and left lateral plates 21 and 22 of the frame of the fixing device 50, between the two plates 21 and 22, with the placement of a pair of bearings 26 between the lengthwise ends of the pressure roller 2 and the two lateral plates 21 and 22, one for one.

The above-described fixation roller 1 and the pressure roller 2 are kept pressed upon each other by a preset amount of pressure generated by a pressure application mechanism (pressing means) (unshown), against the resiliency of the elastic layers 1*b* and 2*b*. Thus, the toner image t on the sheet P of paper is thermally fixed to the sheet P while the sheet P is conveyed between the two rollers 1 and 2 and remains pinched by the two rollers 1 and 2. The fixation roller 1 and the pressure roller 2 form the nip N (fixation nip) that is roughly 6 mm in width in terms of the sheet conveyance direction a. As the fixation roller 1 is rotationally driven, the pressure roller 2 is rotated by the rotation of the fixation roller 1, that is, by the friction that occurs between two rollers 1 and 2 in the nip N, in the counterclockwise direction indicated by an arrow mark B in part (a) of FIG. 1.

On the upstream side of the nip N in terms of the paper conveyance direction, a pre-fixation guiding plate 12 is disposed that guides a sheet P of recording paper to the entrance of the nip N as the sheet P is conveyed to the fixing device 50 from the image forming section. On the downstream side of the nip N in terms of the recording paper conveyance direction a, a separation claw 13 is disposed in the adjacencies of the fixation roller 1. The separation claw 13 is for preventing the sheet P from wrapping around the fixation roller 1 after the sheet P is introduced into the nip N, and also, for separating the sheet P from the fixation roller 1 as the sheet P comes out of the nip N. Further, on the downstream side of the nip N in terms of the recording paper conveyance direction a, a post-fixation guiding plate 14 is disposed that is for guiding the sheet P to the sheet outlet of the apparatus main assembly as the sheet P comes out of the exit of the nip N.

(2-4) Cleaner 15

In this embodiment, the peripheral surface of the fixation roller 1 is cleaned by a cleaner 15 that is a cleaning device that uses a cleaning web 15*a*that is impregnated with a preset amount of silicon oil. The cleaner 15 has a roll of cleaning web 15*a*, a web feeding shaft 15*b* by which the roll of the cleaning web 15*a* is held, a take-up shaft 15*c*, and a pressing roller 15*d* that presses the cleaning web 15*a* upon the peripheral surface of the fixation roller 1 between the two shafts 15*b* and 15*c*.

The pressing roller 15*d* has elasticity and is for cleaning the peripheral surface of the fixation roller 1. More concretely, the pressing roller 15*d* presses the cleaning web 15*a* on the peripheral surface of the fixation roller 1 to wipe away the toner having transferred onto the peripheral surface of the fixation roller 1. As the cleaning web 15*a* is sent, little by little, from the feeding shaft 15*b* to the take-up shaft 15*c*, the section of the cleaning web 15*a*that is in the area of contact between the cleaning web 15*a* and the peripheral surface of the fixation roller 1, being therefore kept pressed upon the peripheral surface of the fixation roller 1, is replaced by the upstream section of the cleaning web 15*a*, relative to the area of contact between the web 15*a* and the fixation roller 1, in terms of the direction in which the cleaning web 15*a* is sent (or taken up). Not only does the silicon oil in the cleaning web 15*a* prevent the fixation roller 1 from being frictionally worn by the contact between the cleaning web 15*a* and the fixation roller 1, but also, it improves the cleaner 15 (cleaning web 15*a*) in cleaning efficiency.

A part of the silicon oil adheres to the fixation roller 1, and moves with the peripheral surface of the fixation roller 1, and plays the role of reducing the amount by which the toner transfers from the sheet P of recording paper onto the fixation roller 1. As toner transfers from the sheet P onto the fixation roller 1, it adheres to the silicon oil layer on the fixation roller 1. Therefore, the toner can be easily scraped away by the cleaning web 15*a*.

(2-5) Cover 16

In a case in which toner that contains a releasing agent (wax) is used, as the toner is heated, the wax (releasing agent) turns into wax dust (microscopic particles that occur as wax vapor condenses), in the adjacencies of the peripheral surface of the fixation roller 1. The cover 16 is for covering the section of the peripheral surface of the fixation roller 1, across which the dust is likely to occur, in order to prevent the dust from dispersing out of the fixing device 50. It is also for boosting the process for increasing the dust in particle size.

More concretely, in this embodiment, the cover 16 is made of a piece of stainless steel plate. The cover 16 is a component for covering the fixation roller 1 across the portion of the peripheral surface of the fixation roller 1, where the dust occurs, that is, the heating area 110 (part (c) of FIG. 3), with the presence of a preset gap D between the peripheral surface of the fixation roller 1 and the cover 16. In terms of the rotational direction of the fixation roller 1, the cover 16 extends so that the downstream edge 16*b* of the cover 16 reaches the adjacencies of an area 111 in which, as the sheet P of recording paper is introduced into the nip N, it is possible for the leading edge Pa of the sheet P to come into contact with the fixation roller 1. The area 111 is an area in which it is possible that, as the sheet P of recording paper enters the nip N, with the leading edge portion of the sheet P curling upward, the leading edge Pa of the sheet P will come into contact with the fixation roller 1, as indicated by a double-dot chain line in part (a) of FIG. 1, and also, as shown in part (c) of FIG. 3.

Referring to part (a) of FIG. 1, an upstream edge portion 16*a* (upstream side of rotational member in terms of rotational direction) of the cover 16 in terms of the rotational direction of the fixation roller 1 is in contact with the web 15*a*, which is a part of the cleaner 15. The upstream edge portion 16*a* of the cover 16, by which the cover 16 contacts with the web 15*a*, is outwardly folded back (outwardly folded portion 16*a*) to ensure that the web 15*a* smoothly slides on the upstream edge portion 16*a* (outwardly folded portion) of the cover 16.

The width W1 of the cover 16 is greater than the width W2 of the area PA of the widest (Wmax) sheet of recording paper usable by the image forming apparatus 40, across which an image can be formed. Further, the width W1 of the cover 16 is greater than the width W3 of the web 15*a*, which is greater than the width W2. A more detailed description of the cover 16 is given later.

(2-6) Fixing Operation

As the main power switch (unshown) of the image forming apparatus 40 is turned on, the control circuit 100 starts up the image forming apparatus 40 in the startup mode. As for the fixing device 50, as the driving force source M is started up, the fixation roller 1 begins to be rotated. As the fixation roller 1 begins to be rotated, the pressure roller 2 begins to be rotated by the rotation of the fixation roller 1. Further, the control circuit 100 starts up the high frequency inverter 101 to flow high frequency current to the excitation coil 7.

In this embodiment, the frequency f2 of the high frequency current is 20 kHz. As high frequency current is applied to the excitation coil 7, the metallic core 1*a* of the fixation roller 1 is heated by the current that is electromagnetically induced in the metallic core 1*a* by the magnetic flux generated by the application of the high frequency current to the excitation coil 7. Referring to part (c) of FIG. 3, the range 110 in which the fixation roller 1 is heated by electromagnetic induction is a range in which the distance between the excitation coil 7 and the inward surface of the fixation roller 1 is very small.

In this embodiment, the coil assembly 4 is roughly semi-circular in cross section. The coil assembly 4 is stationarily disposed in the hollow of the fixation roller 1 in such an attitude that the semi-circular side of the coil assembly 4 faces an up-and-rightward direction, as shown in part (a) of FIG. 1 and part (c) of FIG. 3. In this embodiment, therefore, the heating range 110, across which the fixation roller 1 is heated, in terms of the circumferential direction of the fixation roller 1, is a semi-circular range (180°), and faces up-and-rightward, as shown in part (a) of FIG. 1 and part (c) of FIG. 3.

At this time, referring to part (b) of FIG. 3, the principle based on which the metallic core 1*a*, which is the electrically conductive layer, of the fixation roller 1 is heated by the electromagnetic induction is described. To the excitation coil 7, alternating current is applied from the high frequency inverter 101. Thus, magnetic flux, indicated by an arrow mark H, repeatedly generates and collapses. The magnetic flux H is guided by the magnetic flux passage formed by the combination of the magnetic core 6 and the metallic core 1*a*. As the magnetic flux H is generated by the excitation coil 7 so that it alternately generates and collapses, an eddy current is induced in the metallic core 1*a* in the direction to interfere with the changes in the direction of the magnetic flux. This eddy current is indicated by a referential code C. The amount by which heat is generated by this eddy current C is proportional to the amount (Ω) of the skin resistance Re of the metallic core 1*a*.

The temperature of the fixation roller 1 is quickly increased to a preset startup completion level, which, in this embodiment is 200° C. or the fixation level, by the above-described electromagnetic induction heating system. The temperature of the fixation roller 1 is detected by a thermistor TH, and the information of the detected temperature is inputted into the control circuit 100. The thermistor TH is disposed in contact with, or close to, the outward, or inward, surface of the fixation roller 1. The control circuit 100 controls the electrical power to be supplied to the excitation coil 7 from the high frequency inverter 101, based on the information about the temperature detected by the thermistor TH.

As the control circuit 100 detects through the thermistor TH that the temperature of the fixation roller 1 has reached 200° C., the control circuit 100 puts the image forming apparatus 40 on standby (in a standby mode) in which the image forming apparatus 40 waits for the inputting of image formation signals, and keeps the image forming apparatus 40 on standby. While the image forming apparatus 40 is kept in the standby mode, the control circuit 100, which is a power controlling means, controls the electromagnetic induction heating system in such a manner that the temperature of the fixation roller 1 remains at the fixation level of 200° C.

Then, as image formation signals are inputted while the image forming apparatus 40 is kept in the standby mode, the control circuit 100 activates the image forming section (image formation system) to form an unfixed toner image on the sheet P of recording paper. Further, the control circuit 100 begins to drive the fixation roller 1 for the second time, with a preset control timing. Then, as the sheet P, on which the unfixed toner image t is borne, is conveyed through the nip N, remaining pinched by the fixation roller 1 and the pressure roller 2, the unfixed toner image t is thermally fixed to the surface of the sheet P. During the heating of the unfixed toner image t (during fixing operation), the control circuit 100, which is an electrical power controlling means, controls the high frequency electrical power in such a manner that the temperature of the fixation roller 1 is kept at the fixation level of 200° C.

(3) Releasing Agent in Toner, and Vaporization of Silicon Oil

Next, the releasing agent in the toner, which in this embodiment is wax, is described. It is possible that, while an unfixed toner image t is fixed, a phenomenon called "off-set" that the toner on the sheet P of recording paper transfers onto the fixation roller 1 will occur. The "off-set" phenomenon causes such a problem as an image defect.

In the case of the fixing device 50 in this embodiment, therefore, silicon oil is applied to the peripheral surface of the fixation roller 1 with the use of the cleaner 15. It is impossible, however, to perfectly prevent the occurrence of the above-described toner offset. In this embodiment, therefore, wax is added to the toner. That is, wax is added to the toner so that wax oozes out of the toner while an unfixed toner image t is fixed. Thus, as the unfixed toner image t is heated, the wax in the toner image t melts and enters, along with silicon oil, into the interface between the peripheral surface of the fixation roller 1 and the toner image t on the sheet P, making it possible to perfectly prevent the occurrence of the offset phenomenon (toner resealing function).

Here, by the way, any chemical compound having a molecular structure like wax will be referred to as wax. For example, a chemical compound having a wax-like molecular structure may be made to react with the resin molecule of the toner. As the releasing agent to be added to the toner, substances other than wax may be used. For example, silicon oil, or the like, which can function as a releasing agent, may be used. In this embodiment, paraffin wax was used. The melting point Tm of the wax is roughly 75° C. That is, the melting point Tm is set so that, as long as the temperature of the above-described nip N is kept at the target temperature level, or 200° C., the wax in the toner instantly melts and oozes into the interface between the toner image t and the fixation roller 1.

As the wax oozes out of the toner image t on the sheet P of recording paper, the wax enters the interface between the fixation roller 1 and the toner image t, and remains there. A part of the wax on the fixation roller 1 is heated, however, in a heating range 110 after it transfers onto the fixation roller 1. This phenomenon occurs because the portion of the peripheral surface of the fixation roller 1, which was robbed of heat by the sheet P in the nip N, and therefore, reduced in temperature, is reheated by the excitation coil 7. Thus, the part of the wax, in particular, components that are low in molecular weight, vaporizes (evaporates) as it is moved into the heating range 110 (part (c) of FIG. 3, part (a) of FIG. 7) by the subsequent rotation of the fixation roller 1.

Wax comprises a long chain of molecular components that are different in length. The wax has a specific distribution in terms of the number of long chain molecules. That is, the wax contains components that are low in molecular weight and are low in boiling point, and components that are high in molecular weight and are high in boiling point. It is reasonable to think that it is the low molecular weight components, which are parts of the wax, that vaporize. By the way, a part of the silicon oil with which the web 15*a* is impregnated transfers onto the fixation roller 1 as described above, and vaporizes like wax.

As the wax and the silicon oil vaporize, they are cooled by the air, and condense into microscopic particles. It is, therefore, possible that immediately after the wax and the silicon oil condense into microscopic particles, they may be in the form of a microscopic particle, the size of which is in a range of several nm to several hundreds of nm. That is, it is possible that there will be a dust of wax and silicon oil. Most of the microscopic particles are, however, in the range of several nm to several tens of nm, in size, which can be confirmed by measuring the dust.

By the way, during the making of the present invention, the dust size was measured with the use of a high speed particle sizer (FMPS: product of TSI, Co., Ltd., USA), which can measure a particle diameter distribution, a numerical density (particle count/$cm^3$), and a weight density ($\mu g/m^3$). In the case of the present invention, microscopic particles that are no less than 5.6 nm and no more than 560 nm in the particle diameter, which can be measured by FMPS, are defined as dust particles.

(4) Dust Attributable to Fixation (4-1) Location of Dust Generation

As the sheet P of recording paper, which is bearing a toner image t, is introduced into the nip N, the wax in the toner image t is transferred onto the fixation roller 1. Part (a) of FIG. 7 to part (c) of FIG. 7 show the processes through which the wax, which has transferred onto the fixation roller 1, vaporizes. By the way, parts (a) to (c) of FIG. 7 do not show the cleaner 15. When the fixing device 50 is in the state shown in part (a) of FIG. 7, only the leading edge portion of the toner image t on the sheet P has moved past the nip N. Therefore, it is across a range 135*a* in part (a) of FIG. 7, in terms of the circumferential direction of the fixation roller 1, that the wax adheres to the fixation roller 1. Thus, the wax does not vaporize, because, in the wax adhesion range 135*a*, the peripheral surface of the fixation roller 1 is robbed of heat by its contact with the sheet P, and, therefore, the surface temperature of the fixation roller 1 has reduced.

When the fixing device 50 is in the state shown in part (b) of FIG. 7, the sheet P has been conveyed further into the nip N. Thus, the wax adhesion range in terms of the circumferential direction of the fixation roller 1 has become a range 135*b* that is substantially greater in area than the area of the range 135*a*. That is, the wax adhesion range 135*b* partially overlaps with the heating range 110. The portion of the peripheral surface of the fixation roller 1, which is in the overlapping range (range 136 in part (b) of FIG. 7), is greater in temperature. Therefore, the wax begins to vaporize, and also, begins to turn into dust. The wavy lines in part (b) of FIG. 7 represent the dust that has generated.

When the fixing device 50 is in the state shown in part (c) of FIG. 7, the sheet P has been moved further though the nip N, and, therefore, the wax adhesion range has expanded to become as large as the range 135*c* shown in part (c) of FIG. 7. That is, the wax vaporizes and turns into dust, as indicated by the wavy lines, across the much wider range (range 138 in part (c) of FIG. 7, which is roughly equivalent in size to heating range 110 of fixation roller 1).

In this embodiment, in terms of the rotational direction of the fixation roller 1, the cleaner 15 for cleaning the peripheral surface of the fixation roller 1 is on the upstream side of the heating range 110, and on the downstream side of the nip N. That is, the web 15*a* impregnated with the oil is in contact with the fixation roller 1.

As the silicon oil transfers from the web 15*a* to the fixation roller 1, it vaporizes and turns into dust, like the wax, primarily in the range 138, shown in part (c) of FIG. 7, that is, the range across which the fixation roller 1 is greater in surface temperature, or the range that roughly contains the heating range 110 of the fixation roller 1. It is in the range 138, and in particular, in a section that extends from the area of contact between the web 15*a* and the fixation roller 1, shown in part (a) FIG. 1, to the nip N in terms of the clockwise direction of the drawings. This phenomenon occurs because the peripheral surface of the fixation roller 1 is coated with a fresh supply of silicon oil in the area of contact, described above.

This dust comprises microscopic particles of wax, and microscopic particles of silicon oil. Therefore, the dust is adhesive. Thus, the dust possibly causes problems by solidly adhering to various internal portions of the image forming apparatus 40. For example, if the dust contaminates the recording paper conveyance members such as the pair of discharge rollers 49, by solidly and cumulatively adhering to the recording paper conveyance members, it is possible that the dust (contaminant) will affect image quality by transferring onto the sheet P. Further, it is possible that the dust will clog the filter 47, through which the heated air in the adjacencies of the fixing device 50 is exhausted, by adhering to the filter 47.

(4-2) Dust Properties

According to the researches done by inventors of the present invention, it has been known that the particle diameter of the dust from the fixation roller 1 is dependent upon the ambient temperature of the fixation roller 1.

Referring to part (a) of FIG. 8, when a substance 30 that is high in boiling point (150° C. to 200° C.) is heated to roughly 200° C. by being placed on a heat source 30*a*, the volatile components 31*a* in the substance 30 vaporizes. As the vapor of the volatile components 31*a* comes into contact with the air, which is normal in temperature, the temperature of the vapor immediately drops below the boiling point of the volatile components 31*a*. Thus, the vapor condenses in the air, and turns into microscopic particles 31*b* (dust), the diameter of which is in a range of several nm to several tens of nm. This phenomenon is analogous to the phenomenon that, as the temperature of water vapor falls below the precipitation point, the water vapor turns into microscopic droplets of water, or fog.

Regarding this phenomenon that, as gas that is high in temperature comes into contact with such air that is lower in temperature, it condenses into particles, the greater the air in temperature, the less likely the gas is to condense. Thus, the greater the ambient temperature, the smaller the number of dust particles into which the gas turn. Moreover, the portion of the gas that did not turn into dust particles, and therefore, that remains floating in the air also collects in the adjacencies of dust particles, and condenses onto the dust particles. This phenomenon occurs because, compared to the amount of energy necessary for the residual dust to turn into dust, the amount of energy necessary for the residual dust to condense onto the dust particles is smaller.

It has been known that the dust particles 31*b* that are born through such a process as the one described above randomly move in the air (Brownian motion), and, therefore, grow into dust particles 31*c* that are greater in diameter than the dust particle 31*b*. The greater the dust particle 31*b* in Brownian motion, in other words, the greater the ambient temperature, the greater this growth of dust particle 31*b* in diameter. That is, the greater the ambient temperature of the fixation roller 1, the greater in particle diameter, and the smaller in numerical count, the dust that is born in the adjacencies of the peripheral surface of the fixation roller 1.

As the dust particles 31*b* become greater in size (diameter) than a preset value, they gradually slow down, and eventually become stationary. It may be theorized that this phenomenon occurs because as the dust particles 31*b* grow in size, they become inactive in terms of their Brownian movement.

Regarding the properties of the dust that is traceable to the releasing agent (wax), the dust has been known to adhere to adjacent solid objects. Referring to FIG. 8(*b*), it is assumed here that an air mass α contains a mixture of the dust particles 31*b*that are smaller in size, and the dust particles 31*c*that are larger in size, and the air mass α moves toward the wall 33 along with an air current 32. In this situation, the dust particles 31*c* that are greater in size are more likely to adhere to the wall 33, that is, more likely to be dispersed, than the dust particles 31*b* that are smaller in size, for the following reason.

That is, it may be reasonable to think that the dust particles 31*c* are greater in inertia, and, therefore, collide with the wall 33 at a greater velocity, than the dust particles 31*b*. This phenomenon occurs even if the speed of the air current is no more than 0.2 m/sec, which is the slowest speed that can be measured by a wind speed gauge, that is, even if the speed of the air flow is very slow. Therefore, the greater in size the dust particles 31*c* into which the dust particles 31*b* grow, in particular, the greater the amount by which the dust 31*a* is likely to remain in the fixing device 50 (most of it adheres to fixation roller 1 and the cover 16). In particular, the dust particles 31*c* that are roughly several hundreds of nm in size are likely to remain in the fixing device 50, i.e., they do not disperse out of the 50.

As described above, the dust 31*a* has two properties, that is, the property that the greater the ambient temperature, the greater the size of the particles into which it turns, and the property that the greater the dust in particle size, the more likely the dust is to adhere to adjacent objects. It is evident, therefore, that the problem that the dust remains the same in particle size as it is immediately after its condensation, and therefore, can disperse (escape) out of the fixing device 50, can be solved by increasing in temperature the air mass α in which the dust is floating. By the way, how easily the dust increases in particle size is dependent upon the composition, the temperature, and the density of the dust. For example, as the air mass α increases in temperature, the adhesive components in the dust become softer, increasing, therefore, in adhesiveness. Moreover, the greater the dust in particle density, the greater the dust in the probability at which the dust particles collide among themselves, and therefore, more likely to agglomerate.

(5) Dust Dispersion Prevention System

It is evident from the description above that the measure for preventing the problem that the dust disperses out of the fixing device 50, based on the above-described properties of the dust, is increasing the temperature of the range 138 across which the dust occurs as indicated by wavy lines in part (c) of FIG. 7.

In this embodiment, therefore, the fixing device 50 is structured so that the above-described area of the fixation roller 1 of the fixing device 50, which corresponds to the range 138 across which the dust occurs, is covered as much as possible. That is, the portion of the peripheral surface of the fixation roller 1, which corresponds to the range 138, across which the dust occurs, is covered with the cover 16 that is formed of a piece of SUS plate, with the presence of a gap D between the peripheral surface of the fixation roller 1 and the cover 16.

The cover 16 is disposed so that its downstream edge 16*b* in terms of the rotational direction of the fixation roller 1 is placed in the upstream adjacencies of the range 111, in which it is possible for the leading edge Pa of the sheet P of recording paper to come into contact with the fixation roller 1 as the sheet P is introduced into the nip N. In this embodiment, the edge 16*b* of the cover 16 is on the upstream side of the area 111 by 1 mm to 3 mm, in terms of the rotational direction of the fixation roller 1. The reason why the range 111 is excluded is to prevent the sheet P from coming into contact with the cover 16, in order to ensure that the sheet P is smoothly conveyed.

The upstream edge of the cover 16 in terms of the rotational direction of the fixation roller 1 is in contact with the web 15*a*, which is a part of the cleaner 15. The portion 16*a* of the cover 16 that contacts the web 15*a* is outwardly folded back, in order to enable the web 15*a* to smoothly slide against the cover 16.

Further, the width W1 of the cover 16 is set to be wider than the width W2 of the portion of the widest sheet P (having widest width Wmax) of recording paper usable by the image forming apparatus 40. That is, the fixing device 50 is structured so that the cover 16 extends beyond both edges of the portion PA of the sheet P, across which an image can be formed, in terms of the widthwise direction. Further, the width W1 of the cover 16 is set to be wider than the width W3 of the web 15*a*. Since the width W1 of the cover 16 is set to be wider than the width W3 of the web 15*a*, it is ensured that the peripheral surface of the fixation roller 1 is virtually entirely covered with the cover 16, across the dust generation range.

Because the fixing device 50 is structured as described above, the cover 16 is enabled to cover the peripheral surface of the fixation roller 1, across virtually the entirety of the range 138 across which the wax and the silicon oil turn into the dust. Thus, the heat from the fixation roller 1 can be utilized to increase in temperature, the air mass in the immediate adjacencies of the peripheral surface of the fixation roller 1, in order to increase the dust in particle diameter to prevent the dust from dispersing out of the fixing device 50. As the dust increases in particle diameter, it adheres to the cover 16 or the fixation roller 1. As the dust adheres to the fixation roller 1, it transfers onto the sheet P. The dust does not affect image quality, however, because even the largest dust particles are microscopic.

Further, the cover 16 has a rib 17 that protrudes from the inward side of the cover 16 toward the fixation roller 1, and extends across the entirety of the cover 16 in terms of the lengthwise direction of the cover 16. That is, the lengthwise direction of the rib 17 coincides with the widthwise direction of the cover 16 (rib 17 extends from one lengthwise end of fixation roller 1 to the other). The rib 17 interferes with the airflow into, or out of, the space between the cover 16 and the fixation roller 1, to play the role of promoting the temperature increase of the air in the space.

(6) Positioning of Cover 16 (Gap D Between Cover 16 and Fixation Roller 1)

(6-1) Airflow in Immediate Adjacencies of Fixation Roller 1

Before providing a description of the positioning of the cover 16, the airflow in the immediate adjacencies of the peripheral surface of the fixation roller 1 is described based on the results of the simulation of the flow of the heated air shown in FIG. 5. In this simulation, regarding the relationship between the heat and airflow, it is assumed that the surface temperature of the fixation roller 1 is 200° C. The fixation roller 1 is rotating in the clockwise direction indicated by an arrow mark A at a peripheral velocity of V, the pressure roller 2 is rotating in the counterclockwise direction indicated by an arrow mark B at the same peripheral velocity V as the fixation roller 1, and the sheet P of recording paper is being moved in the leftward direction in FIG. 5 at the same speed V as the peripheral velocity of the two rollers 1 and 2. In this simulation, therefore, the following factors are taken into consideration:

Upward airflow (CD) attributable to natural convection that occurs in the immediate adjacencies of the peripheral surface of the fixation roller 1;

Airflow caused by the movement of the peripheral surface of the fixation roller 1 along the peripheral surface of the fixation roller 1 (RD); and Air flow caused along the sheet P by the movement of the sheet P (PA).

Referring to FIG. 5, at the entrance of the nip N, the airflow (PA) and the airflow (RD) collide with each other, and lose their directionality. Consequently, they join and form an airflow (CF), which seems as if it is coming out of the nip N. This was confirmed. The airflow (CF) flows in the opposite direction from the airflow (RD) while remaining next to the airflow (RD). That is, the airflow (CF) flows upward along the peripheral surface of the fixation roller 1, and is drawn into the upward airflow (CD).

(6-2) Function of Cover 16 and Gap D

As described above, the cover 16 has the function of increasing, in temperature, the air mass that is in the immediate adjacencies of the portion of the peripheral surface of the fixation roller 1, which corresponds to the dust generation range 138. From the standpoint of ensuring that the cover 16 performs its function, the airflow (CF) attributable to the airflow (PA) that occurs in the adjacencies of the surface of the sheet P, and that is lower in temperature, and the upward airflow (CD) have to be prevented from entering the gap D between the cover 16 and the fixation roller 1. Thus, the cover 16 is disposed as close as possible to the peripheral surface of the fixation roller 1, as shown in part (a) of FIG. 1. Therefore, the bottom edge 16*b* of the cover 16 can deflect the airflow (CF) and the upward airflow (CD) in the direction to move away from the fixation roller 1.

Further, by disposing the cover 16 so that the gap D between the cover 16 and the fixation roller 1 becomes no less than 0.5 mm and no more than 3.5 mm, it is possible to ensure that the cover 16 satisfactorily performs its function of deflecting the airflow (CF) and the upward airflow (CD) away from the fixation roller 1. By setting the gap D to be no more than 3.5 mm, it is possible to reduce the dust density of the point C1 (part (a) of FIG. 1), which is in the adjacencies of the fixing device 50, to no more than 70%, as will be described later.

By the way, the reason why the smallest value for the gap D was set to 0.5 mm is that, if the dispersion prevention system is positioned closer to the peripheral surface of the fixation roller 1 than 0.5 mm, it is possible that the cover 16 will come into contact with the fixation roller 1. In this embodiment, the gap D between the cover 16 and the fixation roller 1 is 2 mm. Further, the cover 16 is provided with the rib 17 that is positioned along the bottom edge 16*b* of the cover 16 to enhance the cover 16 in its function to deflect the airflow (CF) and the upward airflow (CD) away from the fixation roller 1.

The gap D between the cover 16 and the fixation roller 1 is desired to be as narrow as possible across the entire range of the cover 16. The narrower the gap D, the better the cover 16 can prevent the airflow (CF) and the upward airflow (CD) from entering the gap D. Moreover, the narrower the gap D, the quicker the space between the fixation roller 1 and the cover 16 can be increased in temperature. In consideration of the thermal deformation of the cover 16, however, and also, the accuracy with which the cover 16 can be positioned, it is difficult in some cases to position the cover 16 so that the gap D becomes as narrow as possible across the entire range of the cover 16.

In this embodiment, therefore, the cover 16 is provided with the rib 17, which is positioned so that the gap D1 between the cover 16 (rib 17) and the fixation roller 1 becomes 1 mm. Providing the cover 16 with the rib 17, which will be closer to the fixation roller 1 than the main section of the cover 16, can enhance the cover 16 in its function of deflecting the airflow (CF) and the upward airflow (CD) away from the fixation roller 1. Further, the rib 17, which is for reducing the gap between the cover 16 and the fixation roller 1 can be formed as an integral part of the cover 16. That is, it is simple in design, and is easy to manufacture.

By the way, the rib 17 may be positioned higher than the adjacencies of the bottom edge 16*b* of the cover 16. For example, the rib 17 may be positioned at roughly the same level as the rotational axis of the fixation roller 1, because, even if the rib 17 is positioned at a higher level than the bottom edge 16*b* of the cover 16, it interferes with the flow of the airflow (CF) and the upward airflow (CD) after enter the gap D between the cover 16 and the fixation roller 1.

Further, in this embodiment, the up-and-outwardly folded portion 16*a* of the cover 16 is placed in contact with the web 15*a*. Since the web 15*a* blocks the gap between the cover 16 and the fixation roller 1, the web 15*a* prevents the air movement in the gap. Thus, the web 15*a* plays the role of assisting the air in the gap in increasing in temperature. By the way, in consideration of the frictional wear or the like of the web 15*a*, it is difficult in some situations, to keep the cover 16 and the web 15*a* in contact with each other. In such situations, the gap between the cover 16 and the web 15*a* is to be made as narrow as possible, from the standpoint of design. For example, it is to be set to be in a range of 1 mm to 2 mm.

(6-3) Effects of Cover 16

By positioning the cover 16 as described above, it was possible to keep the dust density, which is measured at the point C1 shown in part (a) of FIG. 1, to no more than 70%, which is substantially lower than that in a case in which the cover 16 is not present. There is expected a measurement error of 30%. Thus, the target value below which the cover 16 is deemed effective was set to 70%. The point C1 is in the passage through which the dust having generated from the toner is discharged from the space (gap) between the peripheral surface of the fixation roller 1 and the cover 16, by the upward airflow attributable to thermal convection. The point C1 is positioned roughly 20 mm away from the fixation roller 1. If the fixing device 50 is reduced to no more than 70% in terms of the dust density measured at the point C1, it is possible to significantly reduce the contamination of the interior of the image forming apparatus 40 attributable to the wax that escapes from the fixing device 50.

This dust density can be measured with the use of the high speed particle sizer (FMPS), mentioned above. The dust density was measured under the following condition. More concretely, the original was 5% in print ratio, and the fixing operation was continuously carried out for eleven minutes while feeding sheets P of recording paper, of A4 in size, in the landscape attitude. During the operation, the dust density was measured for one minute before the fixing operation was ended (during the 11th minute). The dust density in this embodiment is the average of the dust densities measured throughout the 11th minute.

By the way, the point at which the dust density is to be measured may be any point in the area, in FIG. 4, in which the pair of discharge rollers 49, the filter coil assembly 4, etc., are possibly soiled by the wax, because the effectiveness of the cover 16 in this embodiment in preventing the contamination attributable to the wax in toner can be estimated by measuring how much the dust density was reduced by the cover 16, even though the dust density varies depending on where it is measured.

Further, in this embodiment, the dust density means the particle count density (particle count/$cm^3$) of the dust, that is, the number of dust particles, per cubic centimeter, that are no less than 5.6 nm and no more than 560 nm in size. Thus, it is desired that the cover 16 is designed and positioned so that providing the fixing device 50 with the cover 16 reduces the dust density to no more than 70% of that of the fixing device 50 that does not have the cover 16. By the way, instead of the particle count density (particle count/$cm^3$), the weight density ($\mu g/m^3$) may be used as the dust density.

Next, in this embodiment, the gap D between the cover 16 that does not have the rib 17, and the peripheral surface of the fixation roller 1 was reduced in steps to 4.0 mm, 3.5 mm, 2.5 mm, 2.0 mm, and 1.5 mm. As a result, it was verified that the narrower the gap D, the lower the dust density measured at the point C1. That is, it was confirmed that when the gap D is no more than 3.5 mm, the above-described condition (dust density measured at point C1 is no more than 70%) is satisfied.

In this embodiment, the cover 16 was positioned so that the gap D is 2 mm. Moreover, the cover 16 was provided with the rib 17, and the cover 16 was positioned so that the gap D1 between the rib 17 and the fixation roller 1 is 1 mm. The fixation roller 1 is a rotational component as described above. Therefore, the gap D and the gap D1 change in value as the fixation roller 1 rotates. Further, sometimes, contaminants, such as paper dust, accumulate on the cover 16, and, therefore, the gap D and the gap D1 narrow.

In order to ensure that the cover 16 and the fixation roller 1 do not come into contact with each other, the gap D and gap D1 were set to 1.0 mm in order to provide a sufficient amount of margin for errors in design. The dust density measured at the point C1 in the fixing device 50 designed as described above was no more than 40% of that in a fixing device that did not have the cover 16.

(6-4) Other Methods for Properly Setting Gap D

The gap D may be set according to the peripheral velocity of the fixation roller 1. A referential letter w in FIG. 6 stands for the width of the airflow in FIG. 5. That is, w stands for the distance from the border between the airflow (RD) and the air flow (CD), to the fixation roller 1. The effects of this width w were verified by simulation. FIG. 6 shows the results of the simulation.

Referring to FIG. 6, when the peripheral velocity V of the fixation roller 1 was 115 mm/s, w=1.4 mm, whereas when the peripheral velocity V of the fixation roller 1 was 200 mm/s, w=1.9 mm. As for the volume of the airflow (RD) along the peripheral surface of the fixation roller 1, the greater the speed of the peripheral surface of the fixation roller 1 (that is, peripheral velocity V), the greater the volume of the airflow (RD). Therefore, it was reasonable to think that, as the fixation roller 1 increased in peripheral velocity V, the airflow (RD) increased in volume, and, therefore, the width w increased in value. The following equation can be obtained by linear interpolation of the two points in FIG. 6;

$$w=0.0059\times V+0.72.$$

As long as the gap D is set to be no more than the value of the above-described width w, it is ensured that the cover 16 can block the airflow (CF) and the airflow (CD) to prevent the ambient temperature of the fixation roller 1 from undesirably reducing, in order to minimize the amount of dust generation. In a case in which it is difficult to set the gap D to be no more than the above-described width w, it is acceptable to set the gap D1 to be no more than the above-described width w.

By the way, the smallest value for the width w is 0.5 mm, as described above. Thus, the range of the gap D can be expressed by the following mathematical expression, that is, a combination of the equation given above, and this smallest value for the width w:

$$0.5\leq D\leq 0.0059\times V+0.72.$$

In a case in which it is difficult to keep the value of the gap D within the above-described range, the gap D1 may be set to be within a range that is defined by the following mathematical expression $$0.5\leq D1\leq 0.0059\times V+0.72.$$

The mathematic expressions given above are effective only when the peripheral velocity V of the fixation roller 1 is within a range that satisfies: 115 mm/s≤V≤200 mm/s. The relationship between the peripheral velocity and the width w may be thought to be linear. Therefore, the two expressions are effective even in a case in which the peripheral velocity V is not within the range defined above.

In the foregoing, the structure and the effects of the cover 16, in this embodiment, which is for the fixation roller 1, were described. In consideration of thermal deformation and corrosion of the cover 16, stainless steel (SUS) was selected as the material for the cover 16. The material for the cover 16 may, however, be different from SUS. For example, the material may be a resinous substance. As long as the material for the cover 16 is thermally insulative, the cover 16 is effective to increase the temperature of the immediate adjacencies of the peripheral surface of the fixation roller 1. The rib 17 with which the cover 16 is provided may be an integral part of the cover 16, or an independent part from the cover 16. In this embodiment, the cleaner 15 has the web 15*a*. The cleaner 15 does not, however, need to have the web 15*a*. That is, the cleaner 15 may have a cleaning member other than the web 15*a*. For example, the cleaner 15 may have a cleaning roller.

[Miscellanies]

(1) A fixing device includes an image quality improving device (also called fixing device) for applying heat and pressure, for the second time, to a toner image that has been temporarily or permanently fixed to a sheet of recording paper, in order to improve the toner image in quality, in addition to a device for fixing an unfixed toner image.

(2) The cylindrical rotational member, as an image heating member, that can be heated by electromagnetic induction, may be a flexible endless belt that is loosely fitted around its supporting member, which functions also as a guiding member, and is rotationally driven, or a flexible endless belt that is supported and kept tensioned by multiple members, and that is rotationally driven.

(3) In a case in which the fixation roller (or the cylindrical rotational member) 1, as an image heating member, that can be heated by electromagnetic induction, is rotationally driven, the member 2 that opposes the rotational member fixation roller 1 and forms the nip N in coordination with the fixation roller 1 may be a non-rotational member, such as a rectangular pad, the surface of which is less in coefficient of friction than the fixation roller 1 and a sheet P of recording paper. In the case in which the member 2 is a non-rotational member, as the sheet P of recording paper is introduced into the nip N, it is conveyed through the nip N by the friction between the sheet P and the fixation roller 1 while sliding on the surface of the non-rotational member 2, which is smaller in coefficient of friction than the fixation roller 1 by its back surface (on which image is not formed), remaining sandwiched between the fixation roller 1 and the non-rotational member 2.

(4) The image forming section (image forming system) of the image forming apparatus 40 that forms a toner image on a sheet P of recording paper is not limited to an electrophotographic image forming section of the transfer type in this embodiment. For example, it may be an electrophotographic image forming section that uses a sheet of photosensitive paper as a recording medium, and directly forms a toner image on the sheet of photosensitive paper. Further, it may be an image forming section of the transfer type, which uses a dielectric member on which an image is electrostatically recordable, as an image bearing member, or a magnetic member, as an image bearing member, on which an image can be magnetically recordable. Further, it may be an electrostatic image forming section that uses a sheet of electrostatic recording paper or magnetic recording paper, as a recording medium, and directly forms a toner image on the recording medium. Moreover, it may be a color image forming section.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

According to the present invention, a fixing device that can prevent the dust from dispersing straight out of the fixing device is provided.

The invention claimed is:

1. A fixing apparatus comprising:

a first rotatable member configured to heat, in a fixing nip, an unfixed toner image formed on a sheet with toner comprising a parting material;

a second rotatable member cooperative with said first rotatable member to form said fixing nip;

a cleaner configured to clean said first rotatable member; and a covering member configured to cover said first rotatable member over a range from said cleaner to an entrance of said fixing nip along a rotational direction of said first rotatable member with a gap D of not less than 0.5 mm and not more than 3.5 mm, said covering member being provided with a projection extending toward said first rotatable member at one end portion of said covering member with respect to the rotational direction of said first rotatable member, and said projection extending along a longitudinal direction of said first rotatable member, wherein the gap D (mm) between said covering member and said first rotatable member and a peripheral speed V of said first rotatable member (mm/s) satisfy $$0.5 \leq D \leq 0.0059 \times V + 0.72.$$

2. The fixing apparatus according to claim 1, wherein said covering member is provided with a sliding portion slidable relative to said cleaner at another end portion with respect to the rotational direction of said first rotatable member.

3. The fixing apparatus according to claim 2, wherein said cleaner includes a web, and said sliding portion is slidable relative to said web.

4. The fixing apparatus according to claim 1, wherein said covering member has a width that is greater than a maximum width in which the toner image can be formed on a maximum width sheet usable with said apparatus.

5. The fixing apparatus according to claim 1, further comprising a heating member configured to heat said first rotatable member.

6. The fixing apparatus according to claim 1, wherein the parting material comprises a wax.

* * * * *